US007521160B2

(12) United States Patent
Ohmura et al.

(10) Patent No.: US 7,521,160 B2
(45) Date of Patent: Apr. 21, 2009

(54) IMAGE FORMING METHOD

(75) Inventors: Ken Ohmura, Hachioji (JP); Hiroshi Yamazaki, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 147 days.

(21) Appl. No.: 10/898,498

(22) Filed: Jul. 22, 2004

(65) Prior Publication Data

US 2005/0095516 A1 May 5, 2005

(30) Foreign Application Priority Data

Oct. 29, 2003 (JP) ..... 2003-368607

(51) Int. Cl.
*G03G 15/01* (2006.01)

(52) U.S. Cl. ..... 430/45.56; 430/46.5

(58) Field of Classification Search ..... 430/45, 430/46, 123.41, 45.56, 46.5
See application file for complete search history.

(56) References Cited

U.S. PATENT DOCUMENTS 5,981,132 A * 11/1999 Kurose et al. ..... 430/108.11
6,717,602 B2 * 4/2004 Yamazaki et al. ..... 347/131
2002/0045114 A1 * 4/2002 Kaya et al. ..... 430/45

FOREIGN PATENT DOCUMENTS

JP 10-20598 A 1/1998
JP 2001-318482 A 11/2001
JP 2002-123020 A 4/2002

OTHER PUBLICATIONS

Diamond, Arthur S & David Weiss (eds.) Handbook of Imaging Materials. New York: Marcel-Dekker, Inc. (Nov. 2001) pp. 164-168, 425-427, 636-640.*

* cited by examiner

*Primary Examiner*—Christopher RoDee
(74) *Attorney, Agent, or Firm*—Frishaue, Holtz, Goodman & Chick, P.C.

(57) ABSTRACT

An image forming method, including the steps of: charging each surface of a plurality of amorphous-silicon-based photoreceptors; exposing the each surface of the amorphous-silicon-based photoreceptors to form respective color latent images of yellow, magenta, cyan and black; developing the respective color latent images with corresponding color toners to form respective color visible toner images; and transferring the respective color toner images successively to be piled up on a toner image receiving member, wherein the color toner of each color contains grains having volume average grain size (D4) of 3-7 μm and number average primary grain size of 40-800 nm, and the relationship of $1.04 \leqq B/A \leqq 1.4$ ($6 \leqq A \leqq 30$) is satisfied between an exposure size (A μm) in the main scanning direction in the exposing step and a development size (B μm) corresponding to the exposure size (A μm) in the developing step.

10 Claims, 2 Drawing Sheets

FIG. 1
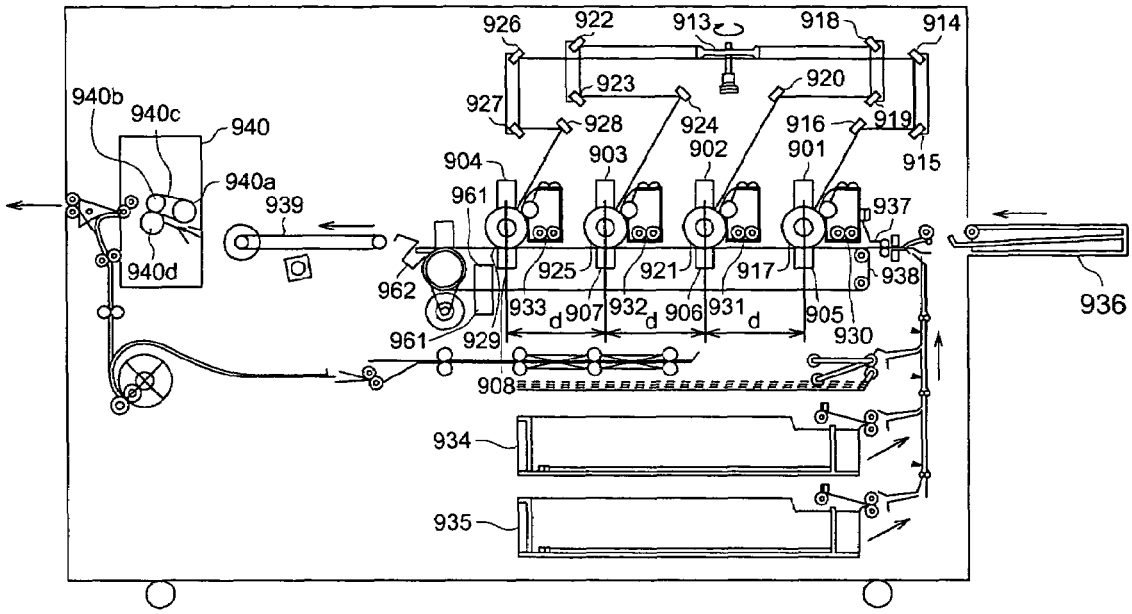
FIG. 2 ( a )
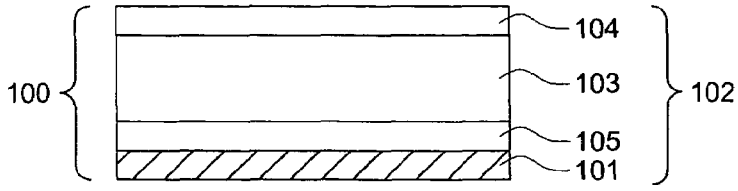
FIG. 2 ( b )
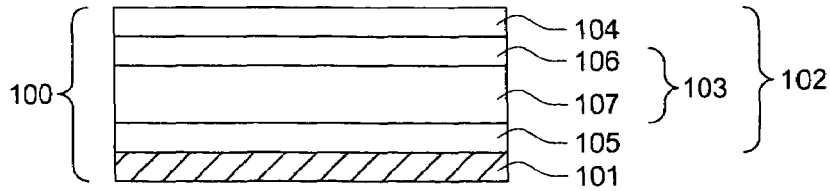

IMAGE FORMING METHOD

FIELD OF THE INVENTION

The present invention relates to an electrophotographic image forming method used for a color copying machine or a color printer.

BACKGROUND OF THE INVENTION

As an occasion for making full-color leaflets or posters, there is a demand for full-color printing for a low number of prints unlike that printed by a commercial printing house, but is only in the range of several tens or hundreds, and yet beautiful color reproduction is still required.

In the area where the full-color printing competes with ordinary printing, the resolution higher than that for conventional electrophotographic system, a broader color reproduction area, high speed printing and lower printing cost are required.

As one of methods for forming full-color images, there is known an image forming apparatus wherein respective color toner images are formed on electrophotographic photoreceptors (hereinafter referred to simply as a photoreceptor) for respective colors, which is called a tandem system, and these color images are superposed on an intermediate transfer body or on a recording sheet (in the invention, the intermediate transfer medium and the recording sheet are classified as recording material) (Patent Document 1). This tandem system is fitted to high speed printing, because both monochromatic printing and color printing can be carried out at the same speed. Specifically, based on color-separated image information, namely, on image information corresponding to each color of yellow, magenta, cyan and black, an electrostatic latent image is formed on each photoreceptor separately, and color toner images for respective colors of yellow, magenta, cyan and black corresponding to respective colors are formed on respective electrostatic latent images, thus, these toner images are superposed on the intermediate transfer body or a recording sheet to form a color image. Namely, in the color image forming apparatus of a tandem system, toner images each having a different hue formed by plural image forming units are superposed on the intermediate transfer body or the recording sheet to form a color image, thereby, it is possible to develop an image forming apparatus of an electrophotographic system capable of forming color images at high speed.

On the other hand, digital full-color image forming apparatuses include a top-level machine for reproducing delicate color cast on a high fidelity basis, and in these digital full-color image forming apparatuses, it is necessary that a latent image of digital color pixels (separate color dot pixels) formed on the electrophotographic photoreceptor is reproduced on a high fidelity basis as a toner image, and for that purpose, it is important to select an electrophotographic photoreceptor capable of making each color pixel to be a latent image on a high fidelity basis and to select toner capable of making each dot latent image to be a visual image on a high fidelity basis. Namely, it is necessary to develop an electrophotographic photoreceptor and toner both capable of reproducing delicate color cast on a high fidelity basis. It is further necessary to develop writing of a latent image, namely, to develop an exposure system.

In the case of the electrophotographic photoreceptor used for the aforesaid tandem system, a separate electrophotographic photoreceptor is used for a toner image of each color. Therefore, a mottle of color and color slippage or doubling tend to be caused if a performance of each electrophotographic photoreceptor is not stable. For example, there is disclosed that an amorphous-silicon-based photoreceptor having high surface hardness and high durability makes it possible to obtain a high-definition image that is excellent in halftone reproducibility (Patent Document 2).

On the other hand, there is proposed (Patent Document 3) an image forming apparatus of a tandem system employing polymeric toner wherein particle sizes can be controlled to be uniform, as a method to improve color reproduction of digital full-color.

It is therefore expected that an image forming apparatus of a top-level type that makes it possible to obtain beautiful full-color images may be realized if the aforesaid amorphous-silicon-based photoreceptor and polymeric toner which will be described later are used together in the image forming apparatus of a tandem system stated above. Further, a competitive power against offset printing is increased, because the photoreceptor of an amorphous silicon type is highly durable and it reduces print cost per one sheet.

(Patent Document 1) TOKKAIHEI No. 10-20598

(Patent Document 2) TOKKAI No. 2002-123020

(Patent Document 3) TOKKAI No. 2001-318482

However, it was confirmed that excellent halftone reproduction and color reproduction on a high fidelity basis are not realized even if a full-color image is formed by using the image forming apparatus of a tandem system employing the aforesaid amorphous-silicon-based photoreceptor and polymeric toner, and it is difficult to realize a technology to form full-color images which are required to reproduce halftone color cast required for the top-level machine on a high fidelity basis, even if known technologies are combined simply.

However, when a diameter of a beam for exposure and a diameter of toner are made to be small simply, color slippage is caused and color reproducibility is deteriorated, because dot slippage in exposure is reproduced by toner on a high fidelity basis. Further, indentation of a thin line was also detected, which was a problem.

Namely, an object of the invention is to provide an image forming apparatus capable of forming a full-color image that is required to reproduce, on a high fidelity basis, the high resolution and halftone color cast which are required for a top-level machine.

SUMMARY OF THE INVENTION

After intensive studies for the problems stated above, the inventors of the invention found out a problem of combination of an electrophotographic photoreceptor and polymeric toner both used for forming full-color images, and thereby, completed the invention. Namely, the inventors found out the reason that a latent image on the amorphous-silicon-based photoreceptor tends to be blurred and each dot image corresponding to each color pixel is not generated accurately because of salts and surfactants supplied from toner, under the mere combination of the amorphous-silicon-based photoreceptor having relatively low surface resistance and polymeric toner formed mainly in water-based medium, and they completed the invention. Namely, the invention is attained by taking any of the following structures.

(Structure 1)

An image forming method having therein a charging step for charging a plurality of amorphous-silicon-based photoreceptors, an exposure step to give exposure to each surface of the charged amorphous-silicon-based photoreceptors, and to form electrostatic latent images for at least black, yellow, magenta and cyan, a developing step to form toner images each having a different color by color toners corresponding to electrostatic latent images each having a different color, a transfer step to superpose the color toner images on a recording material in succession and thereby to transfer them onto the recording material, wherein the color toner of each color contains grains having volume average grain size (D4) of 3-7 μm and an external additive having number average primary grain size of 40-800 nm, and the relationship of $1.04 \leqq B/A \leqq 1.4$ (where, $6 \leqq A \leqq 30$) is satisfied between an exposure size (A μm) in the main scanning direction in the exposure step and a development size (B μm) corresponding to the exposure size (A μm) in the developing step.

(Structure 2)

The image forming method described in the Structure 1 wherein, the amorphous photoreceptor is charged uniformly in the charging step, digital exposure corresponding to images is given in the exposure step, and a color toner image is formed by color toners corresponding to the electrostatic latent image.

(Structure 3)

The image forming method described in the Structure 1 wherein, the exposure step forms electrostatic latent images each being for any of at least black, yellow, magenta, cyan, red, green and blue.

(Structure 4)

The image forming method described in the Structure 1 wherein, the color toner is formed after passing through the process wherein resin grains are associated in the water-based medium.

(Structure 5)

The image forming method described in the Structure 1 wherein, the color toner is formed after passing through the process wherein resin grains are associated in the water-based medium under an existence of releasing agents or of fixing aids.

(Structure 6)

The image forming method described in the Structure 1 wherein, the exposure light source is a laser having a wavelength of 380-530 nm.

(Structure 7)

The image forming method described in the Structure 1 wherein, the color toner has circular form degree mean value of 0.956-0.998.

By using the image forming method of the invention having the structure mentioned above, it is possible to prevent deterioration of dot reproducibility for color images which tends to be caused when the amorphous-silicon-based photoreceptor and polymeric toner are used in the color image forming method of a tandem type, and thereby to provide color images wherein color reproducibility and sharpness are excellent and occurrence of image defects are prevented.

BRIEF DESCRIPTION OF THE DRAWINGS

FIG. 1 is a sectional structure diagram of a color printer representing an example of an image forming apparatus used for a color image forming method of the invention.

FIG. 2 is a schematic structure diagram for illustrating a typical layer structure of a-Si photoreceptor used for a color image forming method of the invention.

DETAILED DESCRIPTION OF PREFERRED EMBODIMENT

Figure 3:
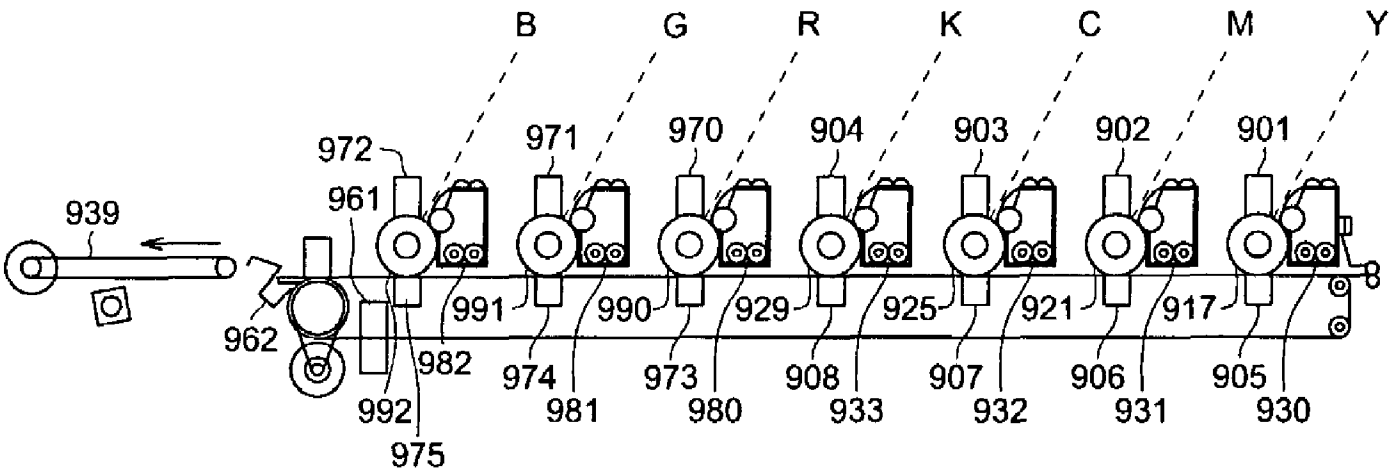
FIG. 3 is a partial and sectional structure diagram for illustrating primary portions of an image forming apparatus of a 7-color tandem system used for a color image forming method of the invention.

Next, a photoreceptor used in the invention will be explained in detail.

An amorphous-silicon-based photoreceptor is used as a photoreceptor used for a color image forming method of the invention.

The amorphous-silicon-based photoreceptor will be explained as follows.

The amorphous-silicon-based photoreceptor of the invention is a photoreceptor having thereon an amorphous silicon layer or a noncrystalline silicon layer.

As these photoreceptors, amorphous-silicon-based photoreceptors disclosed in TOKKAISHO Nos. 54-83746, 57-11556, 60-67951, 62-168161 and 57-158650 can be used.

Amorphous-silicon-based photoreceptors (hereinafter referred to also as "a-Si photoreceptor") will be explained briefly as follows.

FIG. 2 is a schematic structure diagram for illustrating a typical layer structure of an a-Si photoreceptor of the invention.

FIG. 2(*a*) is a schematic structure diagram for illustrating a layer structure of an a-Si photoreceptor of the invention. In the a-Si photoreceptor shown in FIG. 2 (a), lightsensitive layer 102 is provided on conducting support 101 representing a photoreceptor. The lightsensitive layer 102 is composed of photoconductive layer 103 that is made of a-Si:H,X and has photoconductivity, amorphous-silicon-based surface layer 104 and amorphous-silicon-based charge-injection preventing layer 105.

FIG. 2(*b*) is a schematic structure diagram for illustrating another layer structure of the a-Si photoreceptor of the invention. In photoreceptor 100 for an image forming apparatus shown in FIG. 2(*b*), lightsensitive layer 102 is provided on conducting support 101 representing a photoreceptor. The lightsensitive layer 102 is composed of charge generating layer-106 made of a-Si:H,X constituting photoconductive layer 103, charge-transport layer 107, amorphous-silicon-based surface layer 104 and amorphous-silicon-based charge-injection preventing layer 105.

The layer structure of the a-Si photoreceptor is a typical one, and the surface layer and the charge injection preventing layer are not always necessary.

In the a-Si photoreceptor, the conducting support is generally heated to 50-400° C., and a photoconductive layer made of a-Si is formed on the support through a layer casting method such as a vacuum deposition method, a sputtering method, an ion-plating method, a thermal CVD method, a light CVD method and a plasma CVD method (hereinafter referred to as "PCVD method". Among them, the PCVD method, namely, a method to decompose material gas through direct current, or a high frequency or a microwave glow discharge, and to form an a-Si depositional layer is favorable.

A layer structure of the a-Si photoreceptor will be explained as follows.

Conducting Support

A conducting support used in the a-Si photoreceptor of the invention may either be conductive or be insulating. As a conducting support, there are given well-known metals such as Al and Fe as well as alloys thereof exemplified by stainless steel. It is also possible to use a support wherein at least a surface to be provided with lightsensitive layer of a film or a sheet of synthetic resins, or an insulating support of glass or ceramic, is processed to be conductive. A shape of the conducting support may be any of a smooth surface and a rough surface in a cylindrical form or in a form of a sheet-shaped endless belt.

When conducting image recording by using coherence light such as a laser beam, in particular, it is possible to provide irregularities on the surface of the conducting supsport, for solving effectively image troubles caused by the so-called fringe pattern that appears on a visible image. The irregularities to be provided on the surface of support 1101 are prepared by methods disclosed in TOKKAISHO Nos. 60-168156, 60-178457 and 60-225845.

Further, as another method to solve effectively the image troubles caused by the fringe pattern in the case of using coherence light, it is also possible to provide, on the surface of conducting support 101, irregularities of plural cavities each being in a spherical shape. Namely, the surface of the conducting support 101 has irregularities which are more delicate than resolving power required for photoreceptor 1100 for the image forming apparatus, and the irregularities are a plurality of cavities each being in a spherical shape. The irregularities represented by a plurality of cavities each being in a spherical shape to be provided on the surface of the conducting support 101 are prepared by a well-known method described in TOKKAISHO No. 61-231561.

Further, as still another method to solve image troubles caused by the fringe pattern in the case of using coherence light such as a laser beam more effectively, it is also possible to provide an interference-preventing layer such as a light-absorbing layer or an area inside or under the lightsensitive layer 102.

Photoconductive Layer

It is preferable that the a-Si photoreceptor of the invention is formed on a conductive support, or on a subbing layer (not shown) as occasion demands, and it constitutes a part of the lightsensitive layer 102. The photoconductive layer 103 is prepared by a vacuum depositional film forming method under the condition that the numerical value condition of the base casting parameter is established properly so that desired characteristics may be obtained. Specifically, it may be formed by various thin film depositional methods such as, for example, a glow discharge method (low frequency CVD method, AC discharge CVD method such as high frequency CVD method or microwave CVD method, or DC discharge CVD method), a sputtering method, a vacuum deposition method, an ion plating method, an optical CVD method and a thermal CVD method. These thin film depositional methods are used after being selected properly depending on factors including manufacturing conditions, an extent of load of investment of facilities, a manufacturing scale and characteristics required for the photoreceptor for the image forming apparatus, and the glow discharge method is preferable because conditions for manufacturing a photoreceptor for an image forming apparatus having desired characteristics can easily be controlled.

In a method to form the photoconductive layer 103, raw material gas for supplying Si that can supply silicon atom (Si), raw material gas that can supply hydrogen atom or/and raw material gas for supplying X that can supply halogen atom (X) are introduced basically in a reaction vessel whose inside can be decompressed under the desired state of gas, then, glow discharge is made to take place inside the reaction vessel, and a layer made of a-Si:H,X are formed on prescribed support 101 that is installed at the prescribed position in advance.

It is preferable that a hydrogen atom or/and a halogen atom are contained in the photoconductive layer 103 in the invention, and the reason for this is that the foregoing is indispensable for compensating uncoupled bond of silicon atom and for improving layer quality, especially, for improving photoconductivity and charge conservation characteristic. Therefore, it is preferable that content of a hydrogen atom or a halogen atom, or an amount of the sum of a hydrogen atom or a halogen atom is made to be 10-30 atom % of the total amount of a silicon atom and a hydrogen atom or/and a halogen atom, and 15-25 atom % is more preferable.

As a substance capable of becoming Si supplying gas that is used for manufacturing a-Si photoreceptor of the invention, there is given silicon hydride (silanes) which is in the state of gas or is gasifiable, as one to be used effectively, and SiH4 and Si2H6 are further given as preferable ones on the points of easy handling in manufacturing layers and of excellent efficiency of supplying Si.

It is preferable to introduce structurally a hydrogen atom into the photoconductive layer 103 to be formed, then to plan the control of introduction rate of a hydrogen atom to be more easy, and to form a layer by mixing a desired amount of gas of silicon compound containing H2 and/or He or a hydrogen atom to the aforesaid gas, for obtaining layer characteristics attaining an object of the invention. Further, each gas may be used not only independently but also in combination with other plural gases at a prescribed mixture ratio.

Further, as effective ones as raw material gas for supplying a halogen atom used in the invention, there are given preferably, for example, halogen compounds which are in the state of gas or are gasifiable such as halogen gases, halides, interhalogen compounds and silane delivertives displaced by halogen. Further, halogen-atom-containing silicon compound hydride which is in the state of gas or is gasifiable having structural elements of a silicon atom and a halogen atom can be given as an effective one.

For controlling an amount of hydrogen atoms or/and halogen atoms contained in the photoconductive layer 103, it is enough to control a temperature of support 101, for example, an amount of raw material to be introduced into a reaction vessel to be used for containing a hydrogen atom or/and a halogen atom and electric power to be discharged.

In the a-Si photoreceptor of the invention, it is preferable to make the photoconductive layer 103 to contain atoms that control conductivity, as occasion demands. The atoms controlling conductivity may either be contained in the photoconductive layer 103 to be dispersed evenly, or be contained under the condition wherein some portions contain unevenly in the direction of a layer thickness.

As an atom that controls conductivity, there is given the so-called impurities in the field of a semiconductor, and it is possible to use the atom ($3b^{th}$ group atom) belonging to the $3b^{th}$ group in a periodic table giving a p-type conducting characteristic as is known widely, and to use the atom ($5b^{th}$ group atom) belonging to the $5b^{th}$ group in a periodic table giving a n-type conducting characteristic.

Further, raw materials for introducing atoms that control the conductivity may be diluted with H2 and/or He as occasion demands, to be used.

In the a-Si photoreceptor of the invention, it is also effective to make the photoconductive layer 103 to contain a carbon atom and/or an oxygen atom and/or a nitrogen atom. The carbon atom and/or an oxygen atom and/or a nitrogen atom may either be contained uniformly and evenly in the photoconductive layer, or be contained under the condition wherein some portions having uneven distribution where the content changes in the direction of a layer thickness of the photoconductive layer.

In the a-Si photoreceptor of the invention, it is preferable that a layer thickness of the photoconductive layer 103 is determined properly based on the desire, from the viewpoints of an acquisition of desired electrophotographic characteristics and of economic effects, to be 20-50 μm preferably, 23-45 μm more preferably and 25-40 μm most preferably.

It is possible to establish properly a mixture ratio of Si supplying gas to diluted gas, pressure of gas inside the reaction vessel, electric power to be discharged and a temperature of a conducting support, for the purpose of attaining the object of the invention and forming the photoconductive layer 103 having the desired layer characteristics.

Incidentally, the respective conditions mentioned above are not determined separately and independently as a genera rule, but they are determined based on mutual and organic relation so that a photoreceptor having desired characteristics may be formed, which is preferable.

Surface Layer

In the a-Si photoreceptor of the invention, it is preferable that surface layer 104 is further formed on the photoconductive layer 103 that is formed on the conducting support 101 as stated above. This surface layer 104 has a free surface, and is provided to attain the object of the invention mainly on the points of humidity resistance, characteristics for continuous and repeated use, electric pressure resistance, characteristics for working surroundings and durability.

For the surface layer 104, there are used suitably amorphous silicon (a-Si)-based materials, amorphous silicon (hereinafter expressed as "a-SiC:H,X") that contains a hydrogen atom (H) and/or a halogen atom, and further contains a carbon atom, amorphous silicon (hereinafter expressed as "a-SiO:H,X") that contains a hydrogen atom (H) and/or a halogen atom (X), and further contains an oxygen atom, amorphous silicon (hereinafter expressed as "a-SiN:H,X") that contains a hydrogen atom (H) and/or a halogen atom (X), and further contains a nitrogen atom, and amorphous silicon (hereinafter expressed as "a-SiCON:H,X") that contains a hydrogen atom (H) and/or a halogen atom (X), and further contains at least one of a carbon atom, an oxygen atom and a nitrogen atom.

In the a-Si photoreceptor of the invention, for attaining its object effectively, it is preferable that the surface layer 104 is manufactured by a vacuum depositional film forming method under the condition that the numerical value condition of the base casting parameter is established properly so that desired characteristics may be obtained. Specifically, it may be formed by various thin film depositional methods such as, for example, a glow discharge method (low frequency CVD method, AC discharge CVD method such as high frequency CVD method or microwave CVD method, or DC discharge CVD method), a sputtering method, a vacuum deposition method, an ion plating method, an optical CVD method and a thermal CVD method. These thin film depositional methods are used after being selected properly depending on factors including manufacturing conditions, an extent of load of investment of facilities, a manufacturing scale and characteristics required for the photoreceptor for the image forming apparatus, and it is preferable to use the deposition method similar to that for the photoconductive layer from the viewpoint of productivity of the photoreceptor.

For example, when forming the surface layer 104 made of a-SiC:H,X through a glow discharge method, Si-supplying raw material gas capable of supplying silicon atoms (Si), C-supplying raw material gas capable of supplying carbon atoms (C), and H-supplying raw material gas capable of supplying hydrogen atoms (H) and/or X-supplying raw material gas capable of supplying halogen atoms (X) are introduced in a reaction vessel whose inside can be decompressed under the desired state of gas, then, glow discharge is made to take place inside the reaction vessel, and thereby, a layer made of a-SiC:H,X may be formed on support 101 on which the photoconductive layer 103 installed at the prescribed position in advance is formed.

It is preferable that an amount of carbon in the case of forming the surface layer with the main components of a-SiC is in a range of 30-90% of the sum of silicon atoms and carbon atoms.

In the a-Si photoreceptor of the invention, the surface layer 104 needs to contain a hydrogen atom or/and a halogen atom, and this is indispensable for compensating uncoupled bond of a silicon atom and for improving layer quality, especially, for improving photoconductivity characteristics and charge conservation characteristics. Therefore, it is preferable that content of a hydrogen is made to be 30-70 atom % of the total amount of constituent atoms normally, 35-65 atom % preferably, and 40-60 atom % most preferably. It is further desirable that the content of fluorine atoms is made to be 0.01-15 atom % normally, 0.1-10 atom % preferably and 0.6-4 atom % most preferably.

It is known that defects in the surface layer (mainly, dangling bond of a silicon atom and a carbon atom) adversely affect the characteristics as a photoreceptor for an image forming apparatus, resulting in deterioration of charging characteristics caused by charges injected in the photoconductive layer from the free surface, for example, fluctuations in charging characteristics caused by the change of the surface structure under the high humidity, for example, and occurrence of an afterimage phenomenon in the case of repeated use resulted from that charges are injected in the surface layer by the photoconductive layer in the case of corona charging or of light irradiation, and charges are trapped in the defects in the surface layer.

By controlling the hydrogen content in the surface layer to be 30 atom % or more, defects in the surface layer are sharply reduced, and thereby, electric characteristics and high speed continuous use can be improved. On the other hand, if the hydrogen content in the surface layer exceeds 70 atom %, hardness of the surface layer is lowered, and durability falls accordingly.

By controlling the fluorine content in the surface layer within a range of not less than 0.01 atm %, it is possible to attain effectively occurrence of coupling of a silicon atom and a carbon atom in the surface layer. Further, as a function of a fluorine atom in the surface layer, cutting of coupling between a silicon atom and a carbon atom caused by damage such as corona can be prevented effectively. On the other hand, if the fluorine content in the surface layer exceeds 15 atm %, an effect of occurrence of coupling between a silicon atom and a carbon atom in the surface layer and an effect of preventing cutting of coupling between a silicon atom and a carbon atom are seldom observed. Furthermore, residual potential and image memory are observed remarkably because traveling performances of carrier in the surface layer are impeded by excessive fluorine atoms.

The fluorine content and hydrogen content in the surface layer can be controlled by a flow rate of H2 gas, a temperature of a conducting support, discharge power and gas pressure.

With respect to a layer thickness of surface layer 104 in a-Si photoreceptor of the invention, it is desirable that the layer thickness is set to be 0.01-3 μm normally, 0.05-2 μm preferably and 0.1-1 μm most preferably. When the layer thickness is thinner than 0.01 μm, an outer layer is lost while the photoreceptor is used for the reason of abrasion, and when the layer thickness exceeds 3 μm, a decline of electrophotographic characteristics such as an increase of residual potential is observed.

The surface layer 104 of the a-Si photoreceptor of the invention is formed carefully so that its required characteristics may be given as desired. Namely, a substance having structural elements such as Si, C and/or N and/or O and H and/or X takes forms covering from a crystal to an amorphous substance structurally according to its forming conditions, then, shows properties including conducting property, semiconductor property and electric insulating property as electric properties, and shows properties covering from photoconductive properties to non-photoconductive properties. Therefore, in the invention, conditions for forming a chemical compound are selected strictly according to a desire, so that a chemical compound having desired characteristics satisfying the purpose may be formed.

For example, when providing surface layer 104 with a purpose of improving pressure resistance, it is made as a non-single-crystal material whose insulating behavior in a working environment is remarkable.

Further, when improvements of the repeated use characteristic and of the working environment characteristic are the main purposes, a level of the aforesaid electric insulating property is eased to some extent, and non-single-crystal materials having a certain level of sensitivity for light to be irradiated are formed.

Further, it is preferable to control the resistance value of the layer properly when forming the layer to prevent the smear caused by low resistance of surface layer 104, or to prevent an influence of residual potential, and further to improving charging efficiencies on the other hand.

Further, in the a-Si photoreceptor of the invention, it is also effective, for further improvement of characteristics such as charging power, to provide, between the photoconductive layer and the surface layer, a blocking layer (bottom surface layer) wherein contents for carbon atoms, oxygen atoms and nitrogen atoms are lower than those of the surface layer.

It is also possible to provide, between surface layer 104 and photoconductive layer 103, an area wherein contents for carbon atoms and/or oxygen atoms and/or nitrogen atoms are reduced towards the photoconductive layer 103. Due to this, adhesiveness between the surface layer and the photoconductive layer is improved, and an influence of interference caused by reflection of light at the interface can be reduced.

Charge Injection Blocking Layer

In the a-Si photoreceptor of the invention, it is further effective to provide, between the conducting support and the photoconductive layer, a charge injection blocking layer having the function to block injection of charges from the conducting support side. Namely, the charge injection blocking layer has the so-called polarity-dependency wherein there is provided the function to block the injection of charges from the conducting support side to the photoconductive layer side when a free surface of the lightsensitive layer receives charging processing in a constant polarity, and such function is not exhibited when receiving charging processing in the opposite polarity. For vesting such function, it is preferable to make the charge injection blocking layer to contain relatively more atoms which control conductivity, compared with the photoconductive layer.

The conductivity-controlling atoms contained in the charge injection blocking layer may either be distributed evenly and uniformly, or they may be contained in a way where there are some portions in which they are distributed unevenly although they are contained uniformly in the direction of a layer thickness. When distribution density is not uniform, it is preferable that more atoms are distributed on the part of the support.

However, from the viewpoint of obtaining uniformity of characteristics in the direction of the surface, it is preferable that atoms are contained evenly to be distributed uniformly in the direction of the surface that is in parallel with the surface of the support, in any cases.

As an atom that is contained in the charge injection blocking layer and controls conductivity, there are given the so-called impurities in the field of a semiconductor, and atoms in the third group of the periodic table which give p-type conduction characteristic or atoms in the fifth group of the periodic table which gives n-type conduction characteristic can be used.

In the a-Si photoreceptor of the invention, the content of the atoms which are contained in the charge injection blocking layer and control conductivity is determined properly according to the desire so that the object of the invention may be attained effectively.

Further, by making the charge injection blocking layer to contain at least one kind of a carbon atom, a nitrogen atom and an oxygen atom, adhesiveness between the charge injection blocking layer and another layer provided to be in direct contact with the charge injection blocking layer can further be improved.

Carbon atoms, or nitrogen atoms or oxygen atoms contained in the charge injection blocking layer may either be distributed evenly and uniformly, or they may be contained in a way where there are some portions in which they are distributed unevenly although they are contained uniformly in the direction of a layer thickness. However, from the viewpoint of obtaining uniformity of characteristics in the direction of the surface, it is preferable that atoms are contained evenly to be distributed uniformly in the direction of the surface that is in parallel with the surface of the conducting support, in any cases.

In the a-Si photoreceptor of the invention, the content of carbon atoms and/or nitrogen atoms and/or oxygen atoms contained in the area of all layers of the charge injection blocking layer is determined properly so that the object of the invention may be attained effectively.

Hydrogen atoms and/or halogen atoms contained in the charge injection blocking layer exhibit an effect to compensate uncoupled bonds existing in the layer and to improve layer quality.

In the a-Si photoreceptor of the invention, it is preferable that a layer thickness of the charge injection blocking layer is determined to be 0.1-5 μm preferably, 0.3-4 μm more preferably and 0.5-3 μm most preferably, from the viewpoints of an acquisition of desired electrophotographic characteristics and of economic effects.

For forming the charge injection blocking layer in the a-Si photoreceptor of the invention, a vacuum deposition method which is the same as that for forming the aforesaid photoconductive layer is used.

In addition to the foregoing, in the a-Si photoreceptor of the invention, it is desirable that the layer area where at least aluminum atoms, silicon atoms, hydrogen atoms or/and halogen atoms are contained to be distributed unevenly in the layer thickness direction is provided on lightsensitive layer 102 closer to the conducting support 101.

In the a-Si photoreceptor of the invention, for the purpose of further improvement of adhesiveness between the conducting support 101 and the photoconductive layer 103 or the charge injection blocking layer 105, there may be provided an adhesion layer made of amorphous materials wherein Si3N4, SiO2, SiO or a silicon atom, for example, is a base, and hydrogen atoms and/or halogen atoms, carbon atoms and/or oxygen atoms and/or nitrogen atoms are contained.

It is further possible to provide a light-absorbing layer that prevents occurrence of a fringe pattern caused by light reflected from the support as stated above. These charge injection blocking layer, the photoconductive layer and the surface layer are laminated in succession, and thereby, positively charging or negatively charging a-Si photoreceptor is prepared. However, as an a-Si photoreceptor to be used in the invention, the positively charging a-Si photoreceptor is preferable from the viewpoint of sharpness of images.

(Toner Manufacturing Method)

Toner of each color used in the developing step of a color image forming method of the invention contains grains having volume average grain size (D4) of 3-7 μm and an external additive having number average primary grain size of 40-800 nm, and the relationship of $1.04 \leqq B/A \leqq 1.4$ (wherein $6 \leqq A \leqq 30$) is satisfied between exposure size (A μm) in the main scanning direction in the aforesaid exposure step and development size (B μm) corresponding to the exposure size (A μm) in the developing step.

In the following, a method of manufacturing toner of this invention will be detailed.

Further, preferable methods of manufacturing toner of this invention (so-called polymerization toner) also include a method in which toner is prepared by aggregating resin particles in a water-based medium. This method is not specifically limited and includes those described, for example, in JP-A Nos. 5-265252, 6-3299947 and 9-15904 (hereinafter, JP-A refers to Japanese Patent Publication Open to Public Inspection). That is, toner of this invention can be prepared by a method in which dispersed particles of constituent materials such as resin particles and a colorant or micro-particles comprising resin and a colorant are aggregated, particularly, these particles, after having been dispersed in water by use of an emulsifier, are salting out by adding a coagulant of a concentration of not less than a critical aggregation concentration and are gradually grown simultaneously with forming fused particles by thermally fusing at a temperature higher than the glass transition temperature of formed polymer itself, the particle growth is stopped by adding a salting-out terminator when a desired particle diameter is obtained, followed by controlling the shape by smoothening the particle surface while being heated and stirred, and the particles, in a hydrated state as they are, are dried by heating while being fluidized. Herein, a solvent which is soluble infinitely in water may be added in addition to a coagulant.

By utilizing resin particles containing a releasing agent as resin particles, resin particles containing said colorant are preferably prepared by aggregation. Resin particles are preferably prepared by emulsion polymerization, that is, a monomer is emulsion polymerized in a liquid added with an emulsified liquid of appropriate additives to prepare polymerized particles (resin particles). Toner particles with a small distribution can always be prepared in the following preparation of toner particles, because the particle size distribution of resin particles prepared by the emulsion polymerization is nearly monodispersed, resulting in providing toner which does not blur dot latent images on an a-Si photosensitive element and can accurately reproduce them into toner images. That is, toner particles can be manufactured by adding such as an organic solvent and a coagulant into a dispersion of resin particles and colorant particles prepared by emulsion polymerization to aggregate said resin particles, and toner prepared in this manner exhibit small distribution among the lots and is always provided with similar characteristics. Herein, aggregation refers that a plural number of the aforesaid resin particles aggregate and fuse together, and also refers the case that said resin particles and other particles (for example, colorant particles) fuse together.

Coagulants, which are utilized to aggregate the aforesaid resin particles in a water-based medium, are not specifically limited, and those selected from metal salts are preferably utilized. Specifically, listed are salts of alkali metals such as sodium, potassium and lithium as mono-valent metals, salts of alkali earth metals such as calcium and magnesium as bi-valent metals, salts of bi-valent metals such as manganese and copper, and salts of tri-valent metals such as iron and aluminum. Specific salts include sodium chloride, potassium chloride, lithium chloride, calcium chloride, zinc chloride, copper sulfate, magnesium sulfate and manganese sulfate. These may also be utilized in combinations.

These coagulants are preferably added at a concentration not less than a critical aggregation concentration. The critical aggregation concentration is an indication with respect to stability of a water-based dispersion, and indicates the concentration at which aggregation occurs with addition of a coagulant. The critical aggregation concentration varies largely depending on an emulsified component and a dispersant itself. For example, detailed critical aggregation concentration can be precisely determined referring to "Polymer Chemistry 17, 601 (1960), edited by Polymer Society of Japan", written by Seizo Okamura. Further, as another method, a desired salt is added changing the concentration into the particle dispersion in question to measure ζ (zeta) potential of said dispersion, and the salt concentration at which the value of ζ potential changes can be designated as a critical aggregation concentration.

The addition amount of a coagulant of this invention is not less than the critical aggregation concentration, preferably not less than 1.2 times and more preferably not less than 1.5 times, of the critical aggregation concentration.

As "a solvent which is infinitely soluble in water" utilized together with a coagulant is selected from those which do not dissolve the formed resin. Specifically, preferably listed are alcohols such as methanol, ethanol, propanol, isopropanol, t-butanol, methoxyethanol and butoxyethanol, nitrites such as acetonitrile, and ethers such as dioxane. Specifically preferable are ethanol, propanol and isopropanol.

The addition amount of the solvent which is infinitely soluble in water is preferably 1-100 volume % based on the polymer containing dispersion added with a coagulant.

Herein, to make a uniform particle shape, it is preferable that colored particles (an original form of toner) are manufactured by aggregating resin particles in a water-based medium, and a slurry having water content of not less than 10 weight % based on the colored particles is fluidizing dried after said colored particle dispersion having been filtered.

A suspension polymerization method as an example of a manufacturing method of toner of this invention will now be explained. Various constituent materials such as a colorant, appropriately a releasing agent, a charge control agent and a polymerization initiator are added into a polymerizing monomer, and the various constituent materials are dissolved or dispersed in the polymerizing monomer by use of a homogenizer, a sand mill, a sand grinder or an ultrasonic homogenizer. The polymerizing monomer, in which the various constituent materials having been dissolved or dispersed, is dispersed in a water-based medium containing a dispersion stabilizer as oil droplets having a desirable size as toner by use of such as a homo-mixer and a homogenizer. Successively, polymerization reaction is made to proceed by heating the resulting dispersion having been charged into a reaction device (a stirring device), a stirring mechanism of which is the stirring fan described below, or by a method (also referred to as "a mini-emulsion method") in which a water-soluble polymerization initiator is added into the obtained dispersion. After finishing the reaction, the dispersion stabilizer is eliminated, and the system is filtered and washed, followed by being dried resulting in preparation of toner of this invention. According to the mini-emulsion method, since a releasing agent dissolved in an oil phase hardly releases, a sufficient amount of functional substances such as a releasing agent can be incorporated within the formed covering layer of resin particles, being different from ordinary emulsion polymerization.

Herein, a water-based medium referred in this invention means those containing at least 50 weight % of water.

Further, toner of this invention is preferably subjected to an air bubbling treatment or an ozone water treatment in the manufacturing process. Toner having been subjected such a treatment can reduce a residual amount of volatile components remaining in toner particles, resulting in preventing generation of image blurring or image bleeding which may be caused by adhesion of these volatile components to an a-Si photosensitive element. The air bubbling treatment can be achieved by blowing air bubbles into a water-based medium at least either before or after aggregation process in a water-based medium, to treat such as toner particles dispersed in a water-based medium with air bubbles. On the other hand, an ozone water treatment can be performed by adding ozone water either before or after the aforesaid aggregation process in a water-based medium, however, an ozone treatment can be also performed against toner particles being once taken out of the water-based medium.

Polymerizing monomers utilized to constitute resin include styrenes or styrene derivatives such as styrene, o-methylstyrene, m-methylstyrene, p-methylstyrene, amethylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene and p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylamino methacrylate and dimethylaminoethyl methacrylate; acrylic acid ester derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate; olefins such as ethylene, propylene and isobutylene; vinyl halogenides such as vinyl chloride, vinylidene chloride, vinyl bromide, vinyl fluoride and vinylidene fluoride; vinyl esters such as vinyl propionate, vinyl acetate and vinyl benzoate; vinyl ethers such as vinylmethyl ether and vinylethyl ether; vinyl ketones such as vinylmethyl ketone, vinylethyl ketone and vinylhexyl ketone; N-vinyl compounds such as N-vinylcarbazole, N-vinylindole and N-vinylpyrrolidone; vinyl compounds such as vinylnaphthalene and vinylpyridine; and acrylic acid or methacrylic acid derivatives such as acrylonitrile and acrylamide. These vinyl type monomers can be utilized alone or in combination.

Further, resins having cross-linking structures can be prepared by utilizing multi-functional vinyls such as divinylbenzene, ethyleneglycol dimethacrylate, ethyleneglycol diacrylate, diethyleneglycol dimethacrylate, diethyleneglycol diacrylate, triethyleneglycol dimethacrylate, triethyleneglycol diacrylate, neopentylglycol dimethacrylate and neopentylglycol diacrylate.

Further, as a polymerizing monomer constituting resin (particles), utilized can be combinations of those provided with an ionic dissociative group (for example, those provided with a substituent such as a carboxyl group, a sulfonic acid group or phosphoric acid group as a constituent groups of the monomer, and specifically, such as acrylic acid, methacrylic acid, maleic acid, styrenesulfonic acid, allylsulfosuccinic acid, 2-acrylamido-2-mehtylpropanesulfonic acid and acid phosphoxy ethylmethacrylate).

These polymerizing monomers can be polymerized by utilizing a radial polymerization initiator. In this case, an oil-soluble polymerization initiator can be utilized in a suspension polymerization method. The oil-soluble polymerization initiators include an azo type or diazo type initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile and azobisisobutyronitrile; peroxide compound type polymerization initiators or polymer initiators provided with a peroxide in the side chain such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis(4,4-t-butyl peroxycyclohexyl)propane and tris-(t-butyl peroxy)triazine.

Further, in the case of employing an emulsion polymerization method, a water-soluble radical polymerization initiator can be utilized. Water-soluble polymerization initiators include persulfate salts such as potassium persulfate and ammonium persulfate, azobisamino dipropane acetate, azobiscyanovaleric acid and salts thereof, and hydrogen peroxide.

Dispersion stabilizers utilized in a suspension polymerization include calcium tertiary phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina. Further, those generally utilized as surfactants such as polyvinylalcohol, gelatin, methyl cellulose, sodium dodecylbenzenesulfonate, ethyleneoxide adducts and sodium higher alcohol sulfate can be utilized as a dispersion stabilizer.

In this invention, superior resins preferably have a glass transition temperature of 20-90° C. and a softening point of 80-220° C. The glass transition temperature can be measured by a differential thermal analysis method, and the softening point can be measured by use of a flow tester. Further, these resins preferably have a number average molecular weight (Mn) of 1000-100000 and a weight average molecular weight (Mw) of 2000-1000000. Further, the molecular weight distribution is preferably 1.5-100 and specifically preferably 1.8-70.

Toner of this invention contains at least the aforesaid resin and external additives, however, may also appropriately contain such as a colorant, a releasing agent and a charge control agent. In the following, colorants, releasing agents, charge control agents and external additives will be explained.

As colorants utilized in toner of this invention is arbitrarily selected from such as carbon black, magnetic substances, dyes and pigments, and carbon black includes channel black, furnace black, acetylene black, thermal black and lamp black. Magnetic substances include ferromagnetic metals such as iron, nickel and cobalt, alloys containing these metals, compounds of ferromagnetic metals such as ferrite and magnetite, compounds which do not contain a ferromagnetic metal but exhibit ferromagnetism by thermal treatment, for example, alloys of a type referred as Heusler's alloys such as manganese-copper-aluminum and manganese-copper-tin, and chromium dioxide.

As dyes, utilized can be C.I. Solvent Red 1, 49, 52, 58, 63, 111 and 122; C.I. Solvent Yellow 19, 44, 77, 79, 81, 82, 93, 98, 103, 104, 112 and 162; C.I. Solvent Blue 25, 36, 60, 70, 93, and 95; as well as the mixtures thereof. As pigments, utilized can be C.I. Pigment Red 5, 48:1, 53:1, 57:1, 122, 139, 144, 149, 166, 177, 178 and 222; C.I. Pigment Orange 31 and 43; C.I. Pigment Yellow 14, 17, 93, 94 and 138; C.I. Pigment Green 7; C.I. Pigment Blue 15:3 and 60; as well as the mixtures thereof. The number average primary particle diameter varies depending on the types, however, is preferably approximately 10-200 nm.

As methods for addition of a colorant, utilized can be a method in which polymerized particles prepared by an emulsion polymerization are colored by addition of a colorant at a stage of being aggregated by addition of a coagulant or a method in which a colorant is added when a monomer is polymerized to form colored particles. Herein, the colorant the surface of which is treated with such as a coupling agent is preferably utilized so as not to prevent a radial polymerizing property, in the case that a colorant is added at a stage of preparing the polymer.

Further, as a releasing agent, added may be such as a lower molecular weight polypropylene (a number average molecular weight=1500-9000), a lower molecular weight polyethylene, paraffin wax, a synthetic ester wax; natural waxes such as carnauba wax and rice wax.

As for charge control agents, various types commonly known and dispersible in water can be utilized. Specifically, listed are Nigrosine type dyes, naphthenic acid or metallic salts of a higher fatty acid, azo type metal complexes, metal salts of disalicylic acid, dibenzilic acid salts or metal complexes thereof.

Herein, the particles of these charge control agents or releasing agents preferably have a number average particle diameter of approximately 200-900 nm in a state of being dispersed.

Toner of this invention is characterized by being utilized with addition of inorganic micro-particles or organic micro-particles having a number average primary particle diameter of 40-800 nm as external additives. Toner of this invention performs faithful transfer without color doubling and with improved resolution when particles having said number average primary particle diameter of 40-800 nm are utilized as external additives. That is, burying into or releasing from toner, of external additives can be efficiently depressed, resulting in prevention of image bleeding and image blur as well as improved reproducibility of dot images.

Measuring Method of Particle Diameter of Above-Described External Additives:

The particle diameter of external additives utilized in a color image forming method of this invention is represented by a number average primary particle diameter. Said number average particle diameter was obtained by observing randomly selected 100 particles as primary particles with respect to transparent electron-microscopic images at a magnification of 2000 times, and measuring the length in the Fere direction by means of an image analysis, which was number averaged.

These inorganic micro-particles are preferably inorganic oxide particles such as silica, titania and alumina, and these inorganic micro-particles are preferably further subjected to a hydrophobicity treatment with such as a silane coupling agent or a titanium coupling agent. Titanate salts such as strontium titanate and hydroxytalcites are also preferably utilized. The degree of the hydrophobicity treatment is not specifically limited, however, is preferably 40-95 based on methanol wettability. The methanol wettability is an evaluation of wettability against methanol. In this method, 0.2 g of objective inorganic micro-particles are weighed and added into 50 ml of distilled water which is charged in a beaker having a content volume of 200 ml. Methanol is slowly titrated from a bullet, the top of which is immersed into a liquid, until the whole inorganic micro-particles become wet in a state of being stirred slowly. Hydrophobicity is calculated by the following equation when a required amount of methanol to make inorganic particles completely wet is a (ml).

$$\text{Hydrophobicity}=(a/(a+50))\times 100$$

The addition amount of the external additives is 0.1-5.0 weight % and preferably 0.5-4.0 weight % in the toner. Further, various combinations of external additives can be utilized.

Toner utilized in a color image forming method of this invention preferably has a number average particle diameter of 2.5-4.8 μm. By utilizing toner having a particle diameter of this range, prepared can be color images having a high dot density and excellent image quality.

Further, as for the shape of toner, a mean value of circularity represented by the following equation is preferably 0.956-0.998 when not less than 2000 particles of toner particles, which have a particle diameter of not less than 1 μm, were measured.

Circularity=(circumferential length of an equivalent circle)/(circumferential length of a toner particle projected image)=$2\pi\times(\text{projected area of particle}/\pi)^{1/2}$/(circumferential length of a toner particle projected image) wherein, an equivalent circle means a circle having the same area as a projected image of the toner particle, and an equivalent circle diameter means a diameter of said equivalent circle. Herein, the aforesaid circularity can be measured by use of FPIA-2000 (produced by Sysmex Corp.). At this time, the equivalent circle diameter is defined by the following equation.

$$\text{Equivalent circle diameter}=2\times(\text{projected area of particle}/\pi)^{1/2}$$

Further, in an image forming method of this invention, positive charging toner is preferably utilized.

As a manufacturing method of positive charging toner, a commonly known charge control agent such as a tertiary ammonium salt is incorporated in toner, and specifically preferable method is as follows.

Vinyl polymer particles containing an amino group or an ammonium group are preferably adhered onto the outer layer of toner particles. Vinyl polymer particles are preferably a copolymer of styrene, and a vinyl polymerizing monomer containing an amino group or ammonium group, and vinyl polymerization monomer containing an amino group or an ammonium group preferably is compound (1) or compound (2).

Compound (1)

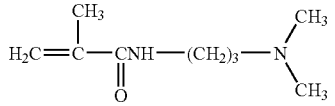

Compound (2)

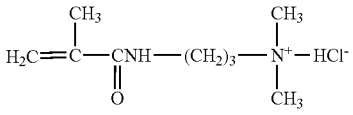

Next, as an example of a color image forming method of this invention, there is a method in which a toner image is formed on a a-Si type photosensitive element by use of a two-component developer comprising a toner and a carrier. In the following, the constitution of a carrier will be described.

A carrier utilized in this invention is preferably a resin dispersion carrier in which magnetic particles having a particle size of 0.1-1.0 μm are dispersed in a binder resin. This is because of the excellent durability and high reproducibility of fine lines, that is, high resolution. As said magnetic particles, utilized can be conventionally known materials such as metals and alloys of iron, ferrite, magnetite or hematite.

Further, binder resin to disperse magnetic particles is preferably thermally curable resin. Thermally curable resins include phenol resin, epoxy resin, polyamide resin, melamine resin, urea resin, unsaturated polyester resin, alkyd resin, xylene resin, acetoguanamine resin, furan resin, silicone resin, polyimide resin and urethane resin, and these resin may be utilized alone or in combination, however, it is preferred that at least phenol resin is contained. To manufacture these resin dispersion carrier, commonly known conventional methods can be utilized. Said resin dispersion carrier can develop a latent image of a relatively low voltage on amorphous silicone type photosensitive element at a high density.

The volume average particle diameter of the aforesaid resin dispersion carrier is 20-50 μm. By using resin dispersion carrier of this range, a latent image of high density dots formed on an amorphous silicone photosensitive element can be precisely developed keeping each dots being independent, resulting in formation of an excellent color image.

Further, carrier utilized in this invention is preferably carrier provided with a silicone resin cover layer which contains conductive particles (carrier covered with silicone resin containing conductive particles). By covering the carrier surface with conductive particles, developability is improved and a latent image of a relatively low voltage on amorphous silicone type photosensitive element can be developed at a high density.

As carrier cores utilized here, that is, magnetic particles, utilized can be those commonly known, which include, for example, metals such as iron, ferrite and magnetite, alloys thereof with a metal such as aluminum or lead, preferably among them ferrite comprising $Fe_2O_3$ containing at least one of $Li_2O$, MgO and MnO, and specifically preferably lithium ferrite, manganese ferrite and magnetite.

As for a cover layer, a coating layer comprising silicone resin containing conductive particles can be formed on the magnetic particle surface by use of such as a solution coating apparatus (a spray method, an immersion method, a fluidized bed method) or a powder coating apparatus. The amount of silicone resin cover layer is preferably 1-10 weight % based on magnetic particles.

Silicone resin containing conductive particles can be prepared by dispersing conductive particles in silicone resin being dissolved with a solvent, or by dispersing conductive particles in silicone resin being thermally melted.

Conductive particles are added in silicone resin for the purpose of primarily controlling charging amount of the developer. The particle diameter is preferably approximately 0.01-0.5 μm, the addition amount is preferably 0.01-30 weight parts and more preferably 0.1-20 weight parts, against 100 weight parts of silicone resin.

(Silicone Resin)

Silicone resins utilized in this invention are conventional ones commonly known, and include, for example, those available on the market such as KR261, KR271, KR272, KR275, KR280, KR282, KR285, KR251, KR155, KR220, KR201, KR204, KR205, KR206, SA-4, ES1001, ES1001N, ES1002T and KR3093, manufactured by Shin-Etsu Silicone Co., Ltd.; and SR2100, SR2101, SR2107, SR2110, SR2108, SR2109, SR2400, SR2410, SR2411, SH805, SH806A and SH840, manufactured by Toray Silicone Co., Ltd.

(Conductive Particles)

Conductive particles include carbon black, graphite, tin oxide, indium oxide, metallic powder, conductive titanium oxide (titanium oxide covered with tin oxide doped with antimony), and carbon black among them is preferred. Specific examples of carbon black include contact black, furnace black and thermal black.

The volume average particle diameter of the aforesaid carrier can be measured typically by use of a laser diffraction mode particle size analyzer, equipped with a wet-type homogenizer, "HELOS" (produced by Sympatec Co., Ltd.).

Next, a manufacturing method of a developer of this invention will be explained.

A developer is manufactured by mixing the aforesaid toner and the aforesaid carrier by use of a mixing device.

The amount of toner in a developer is varied depending on types of toner and carrier and an image forming method, however, is preferably 3-15 weight parts and more preferably 5-10 weight parts based on 100 parts of carrier.

As a mixing device to mix toner and carrier, utilized can be commonly known devices such as a Henschel mixer, a Nauter mixer, a V type mixer and a turbuler mixer, and preferred among them is a Henschel mixer.

Next, the structure of the image forming apparatus used in a color image forming method of the invention will be explained, referring to FIG. 1 and FIG. 3.

FIG. 1 is a sectional structure diagram of a color printer representing an example of the image forming apparatus used in a color image forming method of the invention.

FIG. 1 is a sectional side view of color MFP 104 that has therein image forming units (printer engine) for Y (for yellow), M (for magenta), C (for cyan) and K (for black). In FIG. 1, numerals 901, 902, 903 and 904 represent charging units (charging means), 913 represents a polygon mirror which receives four laser beams emitted from unillustrated semiconductor lasers. One of the laser beams scans photosensitive drum 917 charged uniformly by charging unit 901 through mirrors 914, 915 and 916, then, the following laser beam scans photosensitive drum 921 through mirrors 918, 919 and 920, then, the next laser beam scans photosensitive drum 925 through mirrors 922, 923 and 924 and the last laser beam scans photosensitive drum 929 through mirrors 926, 927 and 928.

On the other hand, the numeral 930 represents a developing unit (developing means) that is supplied with yellow (Y) toner, and it forms Y toner images on photosensitive drum 917, following the laser beam. The numeral 931 represents a developing unit that is supplied with magenta (M) toner, and it forms M toner images on photosensitive drum 921, following the laser beam. The numeral 932 represents a developing unit that is supplied with cyan (C) toner, and it forms C toner images on photosensitive drum 925, following the laser beam. The numeral 933 represents a developing unit that is supplied with black (B) toner, and it forms K toner images on photosensitive drum 929, following the laser beam. When the toner images each having a different color of the aforesaid four colors (Y, M, C and K) are transferred onto the sheet, full-color outputted images are obtained.

A sheet that is fed from the sheet cassettes 934 and 935 or is fed through a by-pass feed tray 936 is sucked to transfer belt 938 through registration roller 937, to be conveyed. While, on the photosensitive drums 917, 921, 925 and 929, there are developed toner images for respective colors in synchronization with sheet feeding timing in advance, and each of these toner images is transferred onto the sheet at the position of each of the color transfer means (composed of transfer belt 938 and of transfer corona units 905, 906, 907 and 908), each time the sheet is conveyed.

Though the toner remaining on the photoreceptor after the toner image is transferred onto the sheet may be removed by providing an exclusive cleaning means for toner removal such as a cleaning blade, it is preferable to arrange so that the toner remaining on the photoreceptor may be collected and the exclusive cleaning means may be omitted (namely, an image forming unit without cleaner) for the purpose to make the image forming unit to be compact to avoid the total image forming apparatus in large size. Since the physical properties of each toner grain of the toner of the invention are uniformalized, residual toner can be collected effectively at the developing means.

The sheet onto which the toner image of each color has been transferred is separated from transfer belt 938, then, is conveyed by conveyance belt 939 so that the toner image is fixed on the sheet by fixing unit (fixing means) 940. The sheet that has slipped out of the fixing unit 940 is guided downward temporarily by flapper 950, then, after the trailing edge of the sheet has left the flapper 950, the sheet turns back in a switch-back manner to be ejected with its surface facing downward. Therefore, when document images composed of plural pages are printed in succession from the forefront page, a group of sheets of a page-number-increasing type is obtained.

The fixing means 940 employs belt fixing. This means the structure having therein heating roller 940*a* having a heating means such as a halogen lamp, supporting roller 940*b* arranged to be in parallel with and to be separate from the heating roller 940*a*, fixing belt 940*c* that is trained about the heating roller 940*a* and the supporting roller 940*b* on a endless basis and pressure roller 940*d* that forms a nip portion with the supporting roller 250 through the fixing belt 940*c*.

It is preferable that the fixing means of the image forming apparatus used in the color image forming method of the invention is the belt fixing stated above. In the belt fixing, toner images can be fixed with soft pressing force, and therefore, detailed dot images can be fixed without being disturbed, and halftone color images can be expressed with rich gradation, which is different from roller fixing.

Incidentally, four photosensitive drums 917, 921, 925 and 927 are arrange at regular intervals of distance d, and a sheet on the conveyance belt 939 is conveyed at constant speed v. Therefore, an unillustrated semiconductor laser is synchronized with timing thereof, and is driven for each color.

FIG. 3 is a partial and sectional structure diagram for illustrating primary portions of the image forming apparatus of a 7-color tandem system housing therein image forming units for R (for red), G (for green) and B (for blue) in addition to image forming units for Y (for yellow), M (for magenta), C (for cyan) and K (for black).

In FIG. 3, the numerals 901, 902, 903, 904, 970, 971 and 972 represent charging units (charging means), and 7 laser beams emitted from unillustrated semiconductor lasers scan respectively photosensitive drums 917, 921, 925, 929, 990, 991 and 992 which are uniformly charged respectively by charging units 901, 902, 903, 904, 970, 971 and 972.

On the other hand, the numeral 930 represents a developing unit (developing means) that is supplied with yellow (Y) toner, and it forms Y toner images on photosensitive drum 917, following the laser beam (shown with broken lines Y). The numeral 931 represents a developing unit that is supplied with magenta (M) toner, and it forms M toner images on photosensitive drum 921, following the laser beam (shown with broken lines M). The numeral 932 represents a developing unit that is supplied with cyan (C) toner, and it forms C toner images on photosensitive drum 925, following the laser beam (shown with broken lines C). The numeral 933 represents a developing unit (developing means) that is supplied with red (R) toner, and it forms R toner images on photosensitive drum 929, following the laser beam (shown with broken lines R). The numeral 980 represents a developing unit that is supplied with green (G) toner, and it forms G toner images on photosensitive drum 990, following the laser beam (shown with broken lines G). The numeral 981 represents a developing unit that is supplied with blue (B) toner, and it forms B toner images on photosensitive drum 991, following the laser beam (shown with broken lines B). The numeral 982 represents a developing unit that is supplied with black (K) toner, and it forms K toner images on photosensitive drum 992, following the laser beam (shown with broken lines K). When the toner images each having a different color of the aforesaid seven colors (Y, M, C, R, G, B and K) are transferred onto the sheet, full-color outputted images are obtained.

A sheet that is fed from the sheet cassette explained in FIG. 1 or is fed through a by-pass feed tray (omitted in FIG. 3 because of the same structure) is sucked to transfer belt 938 to be conveyed. While, on the photosensitive drums 917, 921, 925, 929, 990, 991 and 992, there are developed toner images for respective colors in synchronization with sheet feeding timing in advance, and each of these toner images is transferred onto the sheet at the position of each of the color transfer means (composed of transfer belt 938 and of transfer corona units 905, 906, 907, 908, 973, 974 and 975), each time the sheet is conveyed.

Though the toner remaining on the photoreceptor after the toner image is transferred onto the sheet may be removed by providing an exclusive cleaning means for toner removal such as a cleaning blade, it is preferable to arrange so that the toner remaining on the photoreceptor may be collected and the exclusive cleaning means may be omitted (namely, an image forming unit without cleaner) for the purpose to make the image forming unit to be compact to avoid the total image forming apparatus in large size. Since the physical properties of each toner grain of the toner of the invention are uniformalized, residual toner can be collected effectively at the developing means.

The sheet onto which the toner image of each color has been transferred is separated from transfer belt 938, and is conveyed by conveyance belt 939 so that the toner image is fixed on the sheet by fixing unit (omitted in FIG. 3 because of the same structure) 940 explained in FIG. 1.

An image forming apparatus used for a color image forming method of the invention is capable of forming color images having high image quality, and it is preferable that a single wavelength light source such as a semiconductor laser is used as an imagewise exposure light source of this image forming apparatus (color printer) wherein high density dot latent images are formed on the photoreceptor. It is especially preferable to used a semiconductor laser having a wavelength of 380-530 nm. By using these short wavelength light sources, it is possible to make a diameter of an exposure beam to be as small as 30 μm or less, and thereby to form high density dot latent images on A-Si photoreceptor. With respect to the beam emitted from the light source stated above, its luminance distribution is circular or oval which approximates to the normal distribution whose bottom width is extended to right and left, and for example, in the case of a laser beam, its luminance distribution is an extremely small circular or oval shape wherein a dimension in one direction or in both directions of the main scanning direction on the photoreceptor and the sub-scanning direction is 6-30 μm.

In the invention, the relationship between exposure size (A μm) in the main scanning direction and development size (B μm) in the main scanning direction both formed on an amorphous-silicon-based photoreceptor satisfies the following condition. The exposure size in this case means a diameter of a beam itself emitted from a scanning optical system and formed on the photoreceptor, while, the exposure size in the main scanning direction is one showing the maximum diameter in the main scanning direction of a beam itself necessary for forming one dot formed on the photoreceptor. Further, the development size is a diameter of an electrostatic latent image formed on the photoreceptor irradiated by the beam, and the development size in the main scanning direction is one showing the maximum diameter in the main scanning direction of an electrostatic latent image corresponding to one dot formed on the photoreceptor irradiated by the beam.

$$1.04 \leqq B/A \leqq 1.4$$

By satisfying this condition, an image turns out to be highly detailed, then, the so-called narrow line reproducibility is excellent, and the so-called generation copy goes up to multiple generation copy. Namely, with respect to the relationship between development size (B μm) and exposure size (A μm), by satisfying the aforesaid condition, it is possible to obtain high reproducibility of a dot and to form images with high image quality wherein a dot form is uniformalized. By enlarging the development size to 1.04-1.4 times the exposure size, it is possible to improve sharpness of written one pixel, and thereby to improve reproducibility of an image itself on a visual observation basis. When the development size is less than 1.04 times the exposure size, beam slippage for the exposure appears as it is, and burring as well as out of color registration are caused. When the development size exceeds 1.4 times the exposure size, a clearance between adjoining dots is narrowed to be lost, and reproducibility of narrow lines is lowered, which is a problem. Incidentally, the relationship between the development size and the exposure size in a specific range is attained by controlling potential distribution in one dot, charge amount distribution in toner, laser power, photoreceptor potential and development conditions. By satisfying the relationship between exposure size and development size, it will to be able to improve a toner transferring and to reduce the defective images during the transferring step.

EXAMPLES

Next, embodiments of an image forming method of this invention will be specifically explained, however, the constitution of this invention is not limited thereto. Herein, "part(s)" in the description represents weight part(s).

(Preparation of Cyan Toner 1-C)

After preparing each of a colored particle dispersion for an inner layer of toner particles (M1) and a resin particle dispersion for an outer layer of toner particles (Si), the aforesaid (M1) and (S1) were mixed and the resin particles for an outer layer were adhered on the surface of the colored particles to form the inner layer resulting in preparation of toner 1-C.

1. Manufacturing Process of Outer Layer Resin Particle Dispersion

Prepared was outer layer resin particle dispersion (S1) containing outer layer resin particles (s1) which were to adhere on the colored particle surface to form the inner layer.

(Polymerizing Monomer Solution 1-1-1)

The following composition is designated as polymerizing monomer solution 1-1-1.

| | |
|---|---|
| Styrene | 70.1 g |
| n-butyl acrylate | 19.9 g |
| Methacrylic acid | 10.9 g |
| Compound (1) | 4.5 g |

In a 5000 ml separable flask equipped with a stirring device, a temperature sensor, a condenser and a nitrogen introducing device, the anion surfactant described below (102) of 7.08 g was dissolved in 3010 g of ion exchanged water, and the inside temperature was raised to 80° C. while stirring under a nitrogen gas flow resulting in preparation of a surfactant solution. A polymerization initiator solution, in which 9.2 g of a polymerization initiator (potassium persulfate: KPS) were dissolved in 200 g of ion-exchanged water, was added into the aforesaid surfactant solution, aforesaid polymerizing monomer solution 1-1-1 was titrated over a period of 1 hour after the temperature was raised to 75° C., and the system was heated at 75° C. while stirring for 2 hours after finishing the titration to perform polymerization (the first step polymerization), resulting in preparation of resin particles. This was designated as outer layer resin particles (1-1-1).

Anion surfactant (102): $C_{10}H_{21}(OCH_2CH_2)_3OSO_3Na$ (Polymerizing Monomer Solution 1-1-2)

In a flask equipped with a stirring device, 96.0 g of a releasing agent (pentaerythritol tetraarachic acid ester) were added into the following polymerizing monomer mixture solution, and were dissolved by raising the inside temperature to 80° C. This was designated as polymerizing monomer solution 1-1-2.

| | |
|---|---|
| Styrene | 122.9 g |
| n-butyl acrylate | 49.7 g |
| Methacrylic acid | 16.3 g |

In a 5000 ml separable flask equipped with a stirring device, a temperature sensor and a condenser tube, the anion surfactant described below (101) of 5.7 g was dissolved in 1340 g of ion-exchanged water, resulting in preparation of a surfactant solution. In the aforesaid surfactant solution which had been heated to 80° C., mixed and dispersed was polymerizing monomer solution 1-1-2 for 2 hours by use of a mechanical homogenizer "CLEARMIX" (produced by M Technique Co., Ltd.) which was provided with a circulating path, resulting in preparation of a dispersion (an emulsion solution) containing emulsified particles (oil droplets) having a dispersed particle diameter of 646 nm. Next, 1460 ml of ion-exchanged water, a polymerization initiator solution, in which 6.51 g of a polymerization initiator (potassium persulfate: KPS) were dissolved in 254 ml of ion-exchanged water, 0.75 g of n-octyl-3-mercaptopropionic acid ester and outer layer resin particles (1-1-1) were added into the aforesaid dispersion (an emulsified solution), and the system was heated at 80° C. while stirring for 3 hours to perform polymerization (the second step polymerization), resulting in preparation of resin particles made of outer layer resin particles (1-1-1) as a starting material. This was designated as outer layer resin particles (1-1-2).

Anion surfactant (101) $C_{10}H_{21}(OCH_2C_2)_2OSO_3Na$

Into the above-obtained outer layer resin particles (1-1-2), a polymerization initiator solution in which 8.87 g ofz a polymerization initiator (KPS) were dissolved in 346 ml of ion-exchanged water was added, and successively, the following polymerizing monomer solution (1-1-3) was titrated in 1 hour under a temperature condition of 80° C.

(Polymerizing Monomer Solution 1-1-3)

| | |
|---|---|
| Styrene | 322.3 g |
| n-butyl acrylate | 121.9 g |
| Methacrylic acid | 35.5 g |
| n-octyl-3-mercapto propionic acid ester | 9.55 g |

The system was heated while stirring for 2 hours to perform polymerization (the third step polymerization) after finishing the titration, and was cooled down to 28° C. resulting in preparation of a dispersion of outer layer resin particles (s1) made of outer layer resin particles (1-1-2) as a starting material. This resin particle dispersion was designated as outer layer resin particle dispersion (S1).

2. Manufacturing Process of Inner Layer Colored Resin Particle Dispersion (M1)

2-1. Manufacturing of Resin Particles to Form the Toner Particle Inner Layer (Polymerizing Monomer Solution 2-1-1)

In a flask equipped with a stirring device, 96.0 g of a releasing agent (pentaerythritol tetraarachic acid ester) were added into the following polymerizing monomer mixture solution, and were dissolved by raising the inside temperature to 80° C. This was designated as polymerizing monomer solution 2-1-1.

| | |
|---|---|
| Styrene | 172.9 g |
| n-butyl acrylate | 55.0 g |
| Methacrylic acid | 23.1 g |

On the other hand, in a 5000 ml separable flask equipped with a stirring device, a temperature sensor and a condenser, 2.5 g of the aforesaid anion surfactant (101) were dissolved in 1340 g of ion-exchanged water, resulting in preparation of a surfactant solution. In the aforesaid surfactant solution which had been heated to 80° C., mixed and dispersed was polymerizing monomer solution 2-1-1 for 2 hours by use of a mechanical homogenizer "CLEARMIX" (produced by M Technique Co., Ltd.) which was provided with a circulating path, resulting in preparation of a dispersion (an emulsion solution) containing emulsified particles (oil droplets) having a dispersed particle diameter of 482 nm. Next, after addition of 1460 ml of ion-exchanged water, a polymerization initiator solution, in which 7.5 g of a polymerization initiator (potassium persulfate: KPS) were dissolved in 142 ml of ion-exchanged water, and 6.74 g of n-octanethiol were added into the aforesaid dispersion, and the system was heated at 80° C. while stirring for 3 hours to perform polymerization (the first step polymerization), resulting in preparation of inner layer resin particles. This was designated as inner layer resin particles (2-1-1).

Into the above-obtained inner layer resin particles, a polymerization initiator solution in which 11.6 g of a polymerization initiator (KPS) were dissolved in 220 ml of ion-exchanged water was added, and successively, the following polymerizing monomer solution 2-1-2 was titrated over a period of 1 hour under a temperature condition of 80° C.

| (Polymerizing monomer solution 2-1-2) | |
|---|---|
| Styrene | 291.2 g |
| n-butyl acrylate | 132.2 g |
| Methacrylic acid | 42.9 g |
| n-octanethiol | 7.51 g |

The system was heated while stirring for 2 hours to perform polymerization (the second step polymerization) after finishing the titration, and was cooled down to 28° C. resulting in preparation of a dispersion of inner layer resin particles (2-1-2) made of inner layer resin particles (2-1-2) as a starting material. This resin particle dispersion was designated as outer layer resin particle dispersion (S1).

2-2. Aggregation Process of Toner Particle Inside Layer

Salting out/fusing were performed by utilizing a colorant dispersion described below and a dispersion of the above-described inner layer resin particles (2-1-2).

(Preparation of Colorant Dispersion C)

The aforesaid anion surfactant (101) of 59.0 g was dissolver while stirring in 1600 ml of ion-exchanged water, 280.0 g of cyan pigment C. I. Pigment Blue 15:1 were gradually added into the solution while being stirred, and the system was subjected to a dispersion treatment by use of "CLEARMIX" (produced by M Technique Co., Ltd.) resulting in preparation of colorant dispersion C.

Inner layer resin particles (2-1-2) of 259.3 g, 1120 g of ion-exchanged water and 237 g of the aforesaid colorant dispersion were charged and stirred in a four-neck flask equipped with a temperature sensor, a condenser, a nitrogen introducing device and a stirring device. After the inside temperature was controlled to 30° C., 5 mole/L hydroxide solution was added to adjust the pH 10.

Successively, an aqueous solution, in which 55.3 g of magnesium chloride hexa-hydrate were dissolved in 55.3 ml of ion-exchanged water, was added into the dispersion over a period of 10 minutes at 30° C. Temperature raise was stated after the system was kept for 3 minutes, and the temperature was raised to 90° C. over a period of 60 minutes to perform salting out/fusion of inner layer resin particles and a colorant.

The particle diameter of the particles to be an inner layer was measured by use of "Coulter Multisizer" (produced by Coulter Corp.) while keeping stirring and heating, and the particle growth was retarded by addition of an aqueous solution in which 15.3 g of sodium chloride were dissolved in 100 ml of ion-exchanged water when the volume average particle diameter (volume average grain size (D1)) reached to 5.5 μm.

3. Process to Form Outer Layer of Toner Particles

Outer layer resin particle dispersion (S1) of 87.5 g (converted solid part) was adjusted to pH 8 by adding a 5 mol/L sodium hydroxide solution.

On the other hand, the inner layer resin particle dispersion (M1) was kept being heated and stirred for at least 1 hour, and the aforesaid outer layer resin particle dispersion (S1) was added when the circularity came to 0.944 resulting in fusing to form outer layer resin particles (s1) on the inner layer surface.

Thereafter, an aqueous solution, in which 123.9 g of sodium chloride were dissolved in 500 g of ion-exchanged water, was added into the dispersion to further weaken aggregation power of the particles, and heating and stirring were continued for 2 hours while being subjected to a bubbling treatment at 2 litter per minutes. Then, the system was cooled to 30° C. at 8° C./min and was adjusted to pH 2 by addition of hydrochloric acid, and stirring was stopped. This is designated as a dispersion of toner particles 1-C. The mean value of the circularity of toner particles 1-C was 0.964.

4. Process for Solid-Liquid Separation and Washing

The dispersion of tone particles 1-C was washed while spraying ion-exchanged water of 20 times amount based on the solid after having been treated with a centrifugal dehydration device, resulting in preparation of toner cake 1-C.

5. Drying Process

Toner cake 1-C prepared by washing was dried in a reduced pressure drier until the water content reaches 4 weight %.

6. Process of External Addition and Mixing

Hydrophobic silica, having a number average primary particle diameter of 12 nm, of 0.8 weight parts and hydrophobic silica having a number average primary particle diameter of 150 nm were added in the above-described toner particles 1-C, and the system was mixed for 25 minutes by "Henschel Mixer" (produced by Mitsui-Miike Chemical Industry Co., Ltd.) at a circumferential speed of the stirring fan of 30 m/sec. Thereafter, coarse particles were eliminated by use of a 45 μm mesh sieve, resulting in preparation of cyan toner 1-C comprising toner particles 1-C.

<Preparation of Magenta Toner 1-M>

Magenta toner 1-M was prepared in a similar manner to the preparation of toner 1-C, except that 280 g of cyan pigment C.I. Pigment Blue 15:1 were replaced by 420 g of magenta pigment C.I. Pigment Red 122.

<Preparation of Yellow Toner 1-Y>

Yellow toner 1-Y was prepared in a similar manner to the preparation of toner 1-C, except that 280 g of cyan pigment C.I. Pigment Blue 15:1 were replaced by 420 g of yellow pigment C.I. Pigment Yellow 74.

<Preparation of Black Toner 1-bK>

Black toner 1-bK was prepared in a similar manner to the preparation of toner 1-C, except that 280 g of cyan pigment C. I. Pigment Blue 15:1 were replaced by 420 g of neutral carbon black "REGAL 660" (manufactured by Cabot Corp.)

<Preparation of Red Toner 1-R>

Red toner 1-R was prepared in a similar manner to the preparation of toner 1-C, except that 280 g of cyan pigment C.I. Pigment Blue 15:1 were replaced by 210 g of C.I. Pigment Red 48:1.

<Preparation of Green Toner 1-G>

Green toner 1-G was prepared in a similar manner to the preparation of toner 1-C, except that 280 g of cyan pigment C.I. Pigment Blue 15:1 were replaced by 420 g of copper tetra-(α-hydroxyethoxy)phthalocyanine.

<Preparation of Blue Toner 1-B>

Blue toner 1-B was prepared in a similar manner to the preparation of toner 1-C, except that 280 g of cyan pigment C.I. Pigment Blue 15:1 were replaced by 420 g of an anthraquinone derivative (ORACET Blue 2R, manufactured by Ciba-Geigy Corp.).

Physical properties of thus-prepared 1-C-1-B (toners for example 1) are shown in Table 2.

<Manufacture of Toners 2C-2B: Toners for Example 2>

These were prepared in a similar to manufacture of 1C-1B, except that particle growth was depressed by adding a sodium chloride solution when the volume average particle diameter (D1) came to 3.8 μm in the salting out/fusing process, and that heating and mixing were stopped when the mean circularity came to 0.967 in the toner outer layer forming process. Further, toners 2C-2B were manufactured in a similar manner except that hydrophobic titanium oxide (100 nm) was utilized instead of hydrophobic silica (150 nm) in the addition process of external additives. The physical properties are shown in Table 2.

<Manufacture of Toners 3C-3B: Toners for Example 3>

These were prepared in a similar to manufacture of 1C-1B, except that particle growth was depressed by adding a sodium chloride solution when the volume average particle diameter (DI) came to 6.7 μm in the salting out/fusing process, and that heating and mixing were stopped when the mean circularity came to 0.957 in the toner outer layer forming process. Further, toners 3C-3B were manufactured in a similar manner except that strontium titanate (300 nm) was utilized instead of hydrophobic silica (12 nm) in the addition process of an external additive. The physical properties are shown in Table 2.

<Manufacture of Toners 4C-4*b*K: Toners for Example 4>

Toners 4C-4*b*K were manufactured in a similar manner to the manufacture of toners 1C-1*b*K (4 colors), except that hydrophobic silica (40 nm) was utilized instead of hydrophobic silica (150 nm) in the addition process of external additives. The physical properties are shown in Table 2.

<Manufacture of Toners 5C-5B: Toners for Example 5>

Toners 5C-5B were manufactured in a similar manner to the manufacture of toners 3C-3B, except that hydrophobic titanium oxide (650 nm) was utilized instead of strontium titanate (300 nm). The physical properties are shown in Table 2.

<Manufacture of Comparative Toners 1C-1B: Toners for Comparative Example 1>

The comparative toners 1C-1B were prepared in a similar to the manufacture of 1C-1B, except that particle growth was depressed by adding a sodium chloride solution when the volume average particle diameter (D1) came to 7.8 μm in the salting out/fusing process, and that heating and mixing were stopped when the mean circularity came to 0.941 in the toner outer layer forming process. The physical properties are shown in Table 2.

<Manufacture of Comparative Toners 2C-2B: Toners for Comparative Example 2>

These were prepared in a similar to the manufacture of toners 1C-1B, except that particle growth was depressed by adding a sodium chloride solution when the volume average particle diameter (D1) came to 2.8 μm in the salting out/fusing process, and that heating and mixing were stopped when the mean circularity came to 0.999 in the toner outer layer forming process. Further, comparative toners 2C-2B were manufactured in a similar manner to the manufacture of toners 1C-1B, except that hydrophobic titanium oxide (100 nm) was utilized instead of hydrophobic silica (150 nm) in the addition process of external additives. The physical properties are shown in Table 2.

<Manufacture of Comparative Toners 3C-3B: Toners for Comparative Example 3>

Comparative toners 3C-3B were manufactured in a similar manner to the manufacture of toners 1C-1B, except that hydrophobic titanium oxide (24 nm) was utilized instead of hydrophobic silica (150 nm) in the addition process of external additives. The physical properties are shown in Table 2.

<Manufacture of Comparative Toners 4C-4B: Toners for Comparative Example 4>

Comparative toners 4C-4B were manufactured in a similar manner to the manufacture of toners 1C-1B, except that strontium titanate (1.1 μm) was utilized instead of hydrophobic silica (150 nm) in the addition process of external additives. The physical properties are shown in Table 2.

<Manufacture of Comparative Toners 5C-5B: Toners for Comparative Example 5>

Comparative toners 5C-5B were manufactured in a similar manner to the manufacture of toners 1C-1B, except that hydrophobic titanium oxide (100 nm) was utilized instead of hydrophobic silica (150 nm) in the addition process of external additives.

<Manufacture of Comparative Toners 6C-6B: Toners for Comparative Example 6>

Comparative toners 6C-6B were manufactured in a similar manner to the manufacture of toners 1C-1B, except that hydrophobic titanium oxide (100 nm) was utilized instead of hydrophobic silica (150 nm) in the addition process of external additives. The physical properties are shown in Table 2.

<Example of Manufacturing Carrier>

Manufacture of Magnetic Carrier Core Material Particle Powder A (polymerization A): Spherical magnetite particle powder, the surface of which being provided with aluminum oxide and having a mean particle diameter of 0.24 μm, of 700 g and 300 g of granular hematite particle powder were charged in a Henschel mixer, and 7.5 g of silane type coupling agent having an epoxy group was added to and mixed with the resulting mixed powder having been stirred sufficiently, resulting in treatment of the particle surface constituting the aforesaid mixed powder with the silane type coupling agent having an epoxy group.

Phenol of 125 g, 187.5 g of 37% formalin, 1 kg of the aforesaid mixed powder, the particle surface of which having been treated with silane type coupling agent having an epoxy group, 37.5 g of 25% ammonia water and 125 g of water were charged in a 1-liter flask, and the temperature was raised to 85° C. over a period of 60 minutes followed by reaction•curing at the same temperature for 120 minutes to form complex particles comprising phenol resin and inorganic compound particles. Next, the content of the flask was cooled to 30° C., the supernatant was removed after 1.5 liter of water was added, and further the underlying precipitate was washed and air-dried. Then, the resulting product was dried under a reduced pressure (not more than 5 mmHg) at 150-180° C. to prepare complex polymerized particles (hereinafter, referred to as magnetic carrier core particle powder A (polymer A))

<Synthesis Example of Resin to Cover Core Material>

Synthesis Example of Resin to Cover Core Material:

Methyltriethoxy silane of 100 g (0.56 mole) and 5 g of acetic acid as a hydrolysis catalyst were charged in a flask equipped with a stirrer, a thermometer, a reflux condenser, a dropping funnel and a heating jacket, and the system was gradually heated while being stirred. Water of 12.0 g (0.67 mole) were gradually added drop-wise when the solution temperature came to 80° C. Hydrolysis and condensation reaction were performed while keeping the solution temperature at 80° C. for 6 hours. Next, after volatile components were distillation eliminated under a condition of ordinary pressure and the solution temperature of 130° C., the pressure was gradually reduced, and after the volatile components were further distillation eliminated under a condition of reduced pressure of 30 Torr and the solution temperature of 130° C., the pressure was returned to ordinary pressure, resulting in preparation of colorless and liquid polyorganosyloxane (A) having a viscosity (at 25° C.) of 200 cSt.

The above-obtained polyorganosiloxane (A) of 100 g, 2 g of N-β-aminoethyl)-γ-aminopropyl trimethoxysilane and 70 g of polyoxyethylene nonylphenylether (a nonionic-type surfactant) were charged in a flask having a content volume of 5000 ml equipped with a stirrer, a thermometer and s reflux condenser, and the system was stirred while being heated at 85° C. for 5 hours. Thereafter, volatile components were distillation eliminated under a condition of a reduced pressure of 30 Torr and a solution temperature of 60° C., and the pressure was returned to ordinary pressure to obtain silicone resin.

The resin to cover a core material was prepared as a 20% aqueous solution, which was utilized as a coating solution. This solution was spray coated on 1 kg of magnetic carrier core particle powder A by means of a fluidized bed coating method, followed by drying for 5 minutes and sieving through a 74 μm mesh sieve, resulting in preparation of a carrier.

<Preparation of a-Si Photosensitive Element>

Positive charging photosensitive elements are prepared on an aluminum cylinder, having been subjected to a mirror surface treatment, under the conditions shown in Table 1 by use of a manufacturing apparatus of a photosensitive elements according to a RF-PCVD method.

TABLE 1

| | Charge injection preventing layer | Photo-conductive layer 1 | Photo-conductive layer 2 | Surface layer |
|---|---|---|---|---|
| Gas type and flow rate | | | | |
| $SiH_4$ [$cm^3$/min (normal)] | 100 | 200 | 200 | 10 |
| $H_2$ [$cm^3$/min (normal)] | 300 | 800 | 800 | |
| $B_2H_4$ [ppm] (per $SiH_4$) | 2000 | 2 | 0.5 | |
| NO [$cm^3$/min (normal)] | 50 | | | |
| $CH_4$ [$cm^3$/min (normal)] | | | | 480 |
| Support temperature [° C.] | 280 | 280 | 280 | 280 |
| Inner pressure [Pa] | 67 | 67 | 67 | 53 |
| RF POWER [W] | 500 | 800 | 400 | 250 |
| Layer thickness [μm] | 3 | 20 | 7 | 0.5 |

<Preparation of Developer>

Each toner was mixed with carrier so as to make a toner concentration of 8% by use of a V type mixer for 20 minutes.

<Practical Picture Evaluation>

The above toners and photosensitive elements were mounted on an image forming apparatus of FIG. 3 and the following evaluations were performed.

The exposure wavelength was controlled by a wavelength variable laser oscillator, the exposure aperture by a lens system, and B, that is, A/B by a speed ratio of a photosensitive element to a developing roller, and a toner image (a dot diameter) on a photosensitive element was measured by a microscope. The mean circularity was calculated according to the above-described method.

The values of wavelengths, exposure apertures, development apertures and A/B, in examples 1-5 and comparative examples 1-3, are shown in Table 2.

TABLE 2

| | Toner volume average particle diameter | | | | | | | Average value of toner circularity | | | | | | |
|---|---|---|---|---|---|---|---|---|---|---|---|---|---|---|
| | Y | M | C | bK | R | G | B | Y | M | C | bK | R | G | B |
| Example 1 | 5.6 | 5.6 | 5.6 | 5.7 | 5.6 | 5.6 | 5.6 | 0.966 | 0.964 | 0.966 | 0.963 | 0.965 | 0.966 | 0.966 |
| Example 2 | 3.8 | 3.9 | 3.8 | 3.9 | 3.8 | 3.8 | 3.8 | 0.968 | 0.968 | 0.969 | 0.968 | 0.967 | 0.968 | 0.967 |
| Example 3 | 6.7 | 6.7 | 6.7 | 6.8 | 6.7 | 6.7 | 6.7 | 0.958 | 0.957 | 0.958 | 0.957 | 0.958 | 0.959 | 0.957 |
| Example 4 | 5.6 | 5.6 | 5.6 | 5.7 | — | — | — | 0.966 | 0.964 | 0.966 | 0.963 | — | — | — |
| Example 5 | 6.7 | 6.7 | 6.7 | 6.8 | 6.7 | 6.7 | 6.7 | 0.958 | 0.957 | 0.958 | 0.957 | 0.958 | 0.959 | 0.957 |
| Comparison 1 | 7.8 | 7.8 | 7.8 | 7.6 | 7.8 | 7.8 | 7.8 | 0.941 | 0.944 | 0.945 | 0.942 | 0.941 | 0.942 | 0.941 |
| Comparison 2 | 2.8 | 2.8 | 2.8 | 2.8 | 2.8 | 2.8 | 2.8 | 0.999 | 0.999 | 0.999 | 0.999 | 0.999 | 0.999 | 0.999 |
| Comparison 3 | 5.6 | 5.6 | 5.6 | 5.7 | 5.6 | 5.6 | 5.6 | 0.966 | 0.964 | 0.966 | 0.963 | 0.965 | 0.966 | 0.966 |
| Comparison 4 | 5.6 | 5.6 | 5.6 | 5.7 | 5.6 | 5.6 | 5.6 | 0.966 | 0.964 | 0.966 | 0.963 | 0.965 | 0.966 | 0.966 |
| Comparison 5 | 5.6 | 5.6 | 5.6 | 5.7 | 5.6 | 5.6 | 5.6 | 0.966 | 0.964 | 0.966 | 0.963 | 0.965 | 0.966 | 0.966 |
| Comparison 6 | 5.6 | 5.6 | 5.6 | 5.7 | 5.6 | 5.6 | 5.6 | 0.966 | 0.964 | 0.966 | 0.963 | 0.965 | 0.966 | 0.966 |

| | Toner external additives | | Exposure wavelength | Exposure aperture | | B |
|---|---|---|---|---|---|---|
| | Additive 1 | Additive 2 | (nm) | (μm) | B/A | (μm) |
| Example 1 | Hydrophobic silica (12 nm) | Hydrophobic silica (150 nm) | 457,000 | 24 | 1.18 | 28 |
| Example 2 | Hydrophobic silica (12 nm) | Hydrophobic titanium oxide (100 nm) | 410,000 | 12 | 1.07 | 13 |
| Example 3 | Hydrophobic titanium oxide (24 nm) | Strontium titanate (300 nm) | 530,000 | 30 | 1.38 | 41 |
| Example 4 | Hydrophobic silica (12 nm) | Hydrophobic silica (40 nm) | 457,000 | 24 | 1.17 | 28 |
| Example 5 | Hydrophobic titanium oxide (24 nm) | Hydrophobic titanium oxide (650 nm) | 530,000 | 30 | 1.38 | 41 |
| Comparison 1 | Hydrophobic silica (12 nm) | Hydrophobic silica (150 nm) | 457,000 | 24 | 1.18 | 28 |
| Comparison 2 | Hydrophobic silica (12 nm) | Hydrophobic titanium oxide (100 nm) | 410,000 | 12 | 1.07 | 13 |
| Comparison 3 | Hydrophobic silica (12 nm) | Hydrophobic titanium oxide (24 nm) | 457,000 | 24 | 1.18 | 28 |
| Comparison 4 | Hydrophobic silica (12 nm) | Strontium titanate (1.1 μm) | 530,000 | 30 | 1.38 | 41 |
| Comparison 5 | Hydrophobic silica (12 nm) | Hydrophobic titanium oxide (100 nm) | 410,000 | 24 | 1.02 | 24 |
| Comparison 6 | Hydrophobic silica (12 nm) | Hydrophobic titanium oxide (100 nm) | 410,000 | 24 | 1.45 | 35 |

(Evaluation of Color Doubling)

Halftones of flesh color and of violet color were formed and these were observed through a loupe (at 30 times magnification) to evaluate color doubling.

A: No color doubling was observed at all (excellent).

B: No color doubling was observed visually, however, a slight color doubling (not more than 50 μm) was observed through a loupe (good).

C: A little color doubling (not more than 100 μm) was observed through a loupe, but it is not a problem in practical application (being barely usable in practical application).

D: Color doubling was observed visually (poor).

(Evaluation of Color Reproducibility)

The fixing temperature of each image forming apparatus was set to 140° C., and output were each primary color of magenta (M), cyan (C) and yellow (Y) and secondary colors comprising red ®, blue (B) and green (G) which were 1:1 accumulation of each primary color. As a paper sheet, utilized were art paper (Tokuryo Art, manufactured by Mitsubishi Paper Mills Ltd.) and C2r (smoothness of 28), manufactured by Fuji-Xerox Office Supply Co., Ltd. Herein, Japan Colors are selected as standard colors in Japan by Japanese Domestic Committee of International Standardization Organization Printing Technologies Committee (ISO/TC130). The selection was performed by collecting each one sample of sheet lithographic process ink from typical 8 companies in Japan, and by measuring chromaticity of each color mixed with vehicles under the same condition. The selected Japan Colors were proposed to International Standardization Organization Printing Technologies Committee (ISO) since 1990, and, today, the standard of Japan Color 2002 is designated as a standard of colors in Japan. The standard color samples are supplied from International Standardization Organization Printing Technologies Committee (ISO/TC130), and easily available.

A: Broader color reproduction was obtained compared to Japan Color 2002; being not less than 1.2 times as a polyhedral area on the color coordinate (excellent)

B: Color reproduction same as Japan Color 2002 was obtained (good)

C: Color reproduction similar to Japan Color 2002 can be performed, however, is not as broad as Japan Color 2002 (being barely usable in practical application).

D: The color reproduction was remarkably narrow compared to Japan Color 2002 (poor).

(Evaluation of Resolution)

A test chart of 10-25 lines/mm (write-in data by means of digital exposure) was input, and the image was output using black toner.

The fixed image was observed through a loupe and evaluated was the resolution where the space between lines in the sub-scan direction in the resolution chart was not filled-in and can be discriminated.

A: not less than 20 lines/mm

B: not less than 12 and less than 20 lines/mm

C: not less than 10 and less than 12 lines/mm

D: less than 10 lines/mm

The evaluation results are shown in Table 3.

TABLE 3

| | Color doubling | Color reproducibility | Resolution |
|---|---|---|---|
| Example 1 | A | A | A |
| Example 2 | B | A | A |
| Example 3 | A | A | B |
| Example 4 | A | B | A |
| Example 5 | B | A | B |
| Comparison 1 | B | B | D |
| Comparison 2 | D | D | B |
| Comparison 3 | C | C | D |
| Comparison 4 | C | C | D |
| Comparison 5 | D | D | B |
| Comparison 6 | C | C | D |

According to Table 3, in an image forming method of a tandem mode employing amorphous silicone type photosensitive element and polymer toner, color toners satisfying the conditions of this invention, that is, the combinations of examples 1-5, which have a volume average particle diameter (D4) of 3-7 μm, contain particles having a number average primary particle diameter of 40-800 nm as an external additive, and utilize toners satisfying the relationship of $1.04 \leqq B/A \leqq 1.4$ (wherein, $6 \leqq A \leqq 30$) between an exposure aperture in the primary scan direction in the aforesaid exposure step (A μm) and the development aperture (B μm) corresponding to said exposure aperture (A μm), have achieved good evaluations better than the practically usable range with respect to color doubling, color reproducibility and resolution. On the contrary, comparative example 1, a combination which utilizes color toner having a volume average particle diameter (D4) of not more than 3 μm, was inferior to examples 1-5, in resolution, and comparative example 2, a combination which utilizes color toner having a volume average particle diameter (D4) of not less than 7 μm, showed deterioration of color doubling and color reproducibility.

Further, the combinations, comparative examples 3 and 4, which utilizes toners added with an external additive, a number average particle diameter of which is not more than 40 nm or not less than 800 nm, showed deterioration of color doubling and color reproducibility. Particularly, it is estimated that the deterioration of color reproducibility is attributable to generation of periodical image defects (being identical to the period of photosensitive elements).

Further, comparative example 5, a combination which utilizes color toner having a value of the aforesaid B/A of not more than 1.04, was inferior to examples 1-5, in color doubling and color reproducibility and comparative example 6, a combination which utilizes color toner having a value of said B/A is not less than 1.4, showed deterioration of resolution.

What is claimed is:

1. An image forming method, performed in an image forming apparatus with a tandem system, comprising the steps of:

charging each surface of a plurality of amorphous-silicon-based photoreceptors;

exposing the each surface of the amorphous-silicon-based photoreceptors to form respective color latent images of yellow, magenta, cyan and black;

developing the respective color latent images with two-component developers each of which comprises a corresponding color toner and a carrier to form respective color visible toner images; and transferring the respective color toner images successively to be superimposed on a toner image receiving member, wherein the color toner of each color contains toner grains having volume average grain size (D4) of 3-7 μm and an external additive having number average primary grain size of 40-800 nm, the relationship of $1.04 \leqq B/A \leqq 1.4$ ($6 \leqq A \leqq 30$) is satisfied between an exposure size (A μm) in the main scanning direction in the exposing step and a development size (B μm) corresponding to the exposure size (A μm) in the developing step, and the carrier comprises magnetic particles dispersed in a resin containing phenol resin.

2. The image forming method of claim 1, wherein the amorphous photoreceptor is charged uniformly in the charging step, digital exposure corresponding to images is given in the exposing step, and a color toner image is formed by color toners corresponding to the electrostatic latent image.

3. The image forming method of claim 1, wherein the color latent images each being for any of at least black, yellow, magenta, cyan, red, green and blue are formed in the exposing step.

4. The image forming method of claim 1, wherein the color toner is formed after passing through the process wherein resin grains are associated in the water-based medium.

5. The image forming method of claim 1, wherein the color toner is formed after passing through the process wherein resin grains are associated in the water-based medium under an existence of at least one of releasing agents and fixing aids.

6. The image forming method of claim 1, wherein an exposure light source in the exposing step is a laser having a wavelength of 380-530 nm.

7. The image forming method of claim 1, wherein the color toner has degree of circularity of 0.956-0.998.

8. The image forming method of claim 1, wherein the magnetic particles are iron, iron alloy, ferrite, magnetite or hematite.

9. The image forming method of claim 8, wherein a particle diameter of the magnetic particles is 0.1-1.0 μm.

10. The image forming method of claim 1, wherein a volume average particle diameter of the carrier is 20-50 μm (D4).

* * * * *